United States Patent [19]

Medney

[11] 4,312,162

[45] Jan. 26, 1982

[54] REINFORCED POLE

[76] Inventor: Jonas Medney, 3504 Woodward St., Oceanside, N.Y. 11572

[21] Appl. No.: 66,562

[22] Filed: Aug. 15, 1979

[51] Int. Cl.[3] ..... E04H 12/16; E04H 12/12

[52] U.S. Cl. ..... 52/309.16; 52/40; 52/223 R; 52/309.1; 52/727

[58] Field of Search ..... 52/40, 309.1, 309.16, 52/727, 223 R

[56] References Cited

U.S. PATENT DOCUMENTS

| | | | |
|---|---|---|---|
| 2,850,890 | 9/1958 | Rubenstein | 52/727 X |
| 2,870,793 | 1/1959 | Bailey | 52/727 X |
| 2,921,463 | 1/1960 | Goldfein | 52/223 R |
| 3,301,926 | 1/1967 | Reiland | 52/727 X |
| 3,574,104 | 4/1971 | Medler | 52/727 X |
| 3,813,837 | 6/1974 | McClain et al. | 52/309.1 |
| 4,177,306 | 12/1979 | Schulz et al. | 52/309.1 |

FOREIGN PATENT DOCUMENTS

| | | | |
|---|---|---|---|
| 209828 | 8/1957 | Australia | 52/727 |
| 1097113 | 1/1961 | Fed. Rep. of Germany | 52/309.1 |

*Primary Examiner*—Alfred C. Perham

*Attorney, Agent, or Firm*—Posnack, Roberts, Cohen & Spiecens

[57] ABSTRACT

A fiberglass pole suited for use in electric transmission systems and reinforced against flexure stress includes a plurality of reinforcing regions perimetrically disposed and selectively placed thereon. The regions are integral with the pole and are formed of composite material that includes a plurality of pre-stressed longitudinally disposed fibers and a bonding agent embedding the fibers and structurally joining the same to the pole.

15 Claims, 6 Drawing Figures

REINFORCED POLE

FIELD OF THE INVENTION

This invention relates to a structural element and more particularly it relates to a reinforced utility pole of composite design.

BACKGROUND OF THE INVENTION

The conventional utility pole is wood and made from a tree trunk that has been processed to produce the customary lathed pole, generally cylindrical and of somewhat tapered shape. To this shaped trunk an impregnant and preservative is applied under pressure, to retard deterioration such as rot, decay and insect infestation. Conventionally, the preservative is creosote or an oil solution of pentachlorophenol and on application thereof, the wooden pole exhibits a life in excess of ten years under optimum conditions.

More often than not, optimum conditions do not prevail. The type of loading on the pole effects a shortening of its life. Indeed, wooden poles are severely limited in their load carrying capabilities because of their relatively low tensile, compressive and shear strengths when compared to metal poles and this is a severe limiting factor to expanding use of wooden poles.

Wooden poles exhibit other design limitations. For example, the voltages that can be safely carried near or on wooden poles is limited since the dielectric properties of wood vary with its relative wetness. Then too, certain environments mandate that the wooden poles be wrapped or jacketed in a fiberglass or resin jacket for added strength and prolonged life, which processes add to the cost of the finished product. Yet there is another factor detracting from further application of wooden poles impregnated, coated or otherwise treated. Competing uses of wood, a relatively limited natural resource, coupled with the relative shortage of wood generally, has caused the per se cost of same to soar. Hence, what was once an abundant and cheap source of structural material has come to be realized as a limited resource to be carefully conserved. Further, the rampant falling of living trees to make utility poles may adversely affect the ecological balance in a given area and so wood production has come under close scrutiny.

As an alternative structural material, it has been propounded to use metal, particularly aluminum. Yet this approach has several disadvantages, not the least of which is the enhancement of the probability of undesirable electrical phenomena associated with grounded and conductive supports contiguous to high voltage wire. And, metals generally are heavy and not inexpensive.

OBJECTS OF THE INVENTION

It is, therefore, an object of the present invention to provide an improved utility pole of fiberglass.

It is a further object of the present invention to provide a utility pole of composite material that is fabricated with its cross section tailored to withstand bending and flexural loads applied thereon.

It is another object of the present invention to provide a utility pole of helically wound fiberglass having discrete strengthening areas that are integral with the pole and thereby allow the same to be made during a continuous process.

It is still a further object of the present invention to provide a composite structural element having high dielectric properties, that is resistant to corrosive environmental agents and that is relatively light weight and easy to manufacture.

Other objects and features of the present invention will become apparent from the following detailed description considered in connection with the accompanying drawings. It is to be understood, however, that the drawings are designed for purposes of illustration only and not as a definition of the limits of the invention for which reference should be made to the appending claims.

BRIEF DESCRIPTION OF THE DRAWINGS

In the drawing wherein the same reference numeral denotes the same element throughout the several views.

DESCRIPTION OF THE PREFERRED EMBODIMENTS

Figure 1:
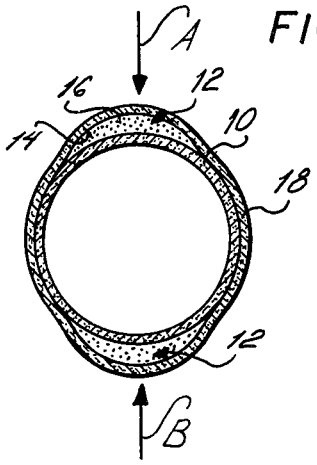
FIG. 1 is a cross-sectional view of a utility pole according to the present invention having reinforcing means in two opposed peripheral regions that project outwardly thereof.

Generally, the present invention provides for a hollow pole or tube having discrete reinforcing areas placed strategically at peripheral regions. The pole is typically of synthetic material particularly filament wound resin-bonded fiberglass, and the reinforcing would typically be pre-stressed fiberglass or steel strands running longitudinally along the pole periphery and rendered integral therewith by bonding with a suitable resin such as an epoxy or polyester. The resulting structure is fabricated in a continuous process and exhibits far greater resistance to elastic stress, both tension and compression, than conventional synthetic or man-made poles.

Referring now to the drawing, there is shown several embodiments of the inventive construction applied to utility poles.

In FIG. 1, a pole or hollow tube 10 of synthetic material, preferably helically wound resin-bonded fiberglass, includes a pair of opposed discrete reinforcing regions coextensive with the length of the pipe and referred to generally by reference numeral 12. Each reinforcing region 12 is formed of a matrix of pre-stressed reinforcing strands or fibers 14 having their longitudinal axis aligned with the longitudinal axis of tube 10, and bonded or impregnated one to the other by a suitable bonding agent 16 such as an epoxy or polyester resin. As shown, each reinforcing region 12 is diametrically positioned on the external periphery of tube 10 and runs or is coextensive with the longitudinal length thereof. The pole further includes a resin bonded fiberglass coating 18. The addition of discrete reinforcing regions 12 increases the area and consequent inertial moment of the pole for a given tube diameter. And, from a materials standpoint, the composite strands 14 in an embedding matrix of epoxy 16 renders the resulting structure of greater strength than either of the two elements alone. Consequently, the pole of FIG. 1 exhibits added stiffness in flexure particularly when stressed in the direction of arrows A or B that are, for example, simplified representations of the loads caused by electrical wires.

Figure 2:
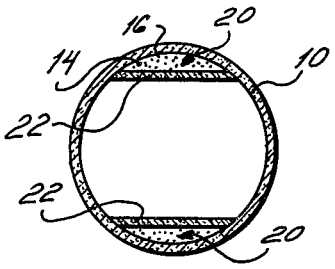
FIG. 2 is a cross-sectional view of another embodiment of the present invention.

In FIG. 2 a modified form of the present invention is shown that is similar to that described in FIG. 1. In FIG. 2 a pair of discrete reinforcing regions 20 are attached in confronting relation to the inside periphery of tube 10. Each region 20, as was region 12, is comprised of a composite consisting of pre-stressed reinforcing strands 14 in an embedding or impregnating matrix of epoxy 16. Regions 20 are rendered integral to the pipe 10 during the fabrication thereof by a fiberglass coating 22.

Figure 3:
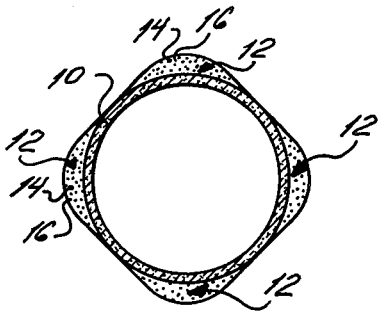
FIG. 3 is a cross-sectional view of a further embodiment of the present invention having reinforcing means in quadrature and outwardly placed on the pole.

Turning now to FIG. 3 there is shown another embodiment of the present invention similar to FIG. 1. Disposed on the outside periphery of tube 10 is a quadrilateral arrangement of discrete reinforcing regions 12. As was described for the preceding figures, each region includes pre-tensioned reinforcing strands 14 running the length of the tube and aligned complimentary to the longitudinal axis thereof. Each strand is bonded one to the other by a resin medium 16. The resin 16 hardens glasslike and, of course, provides a molecular bond to pipe 10 so that as shown in FIG. 3, the epoxy periphery can, by itself, define the outside of the pipe.

Figure 4:
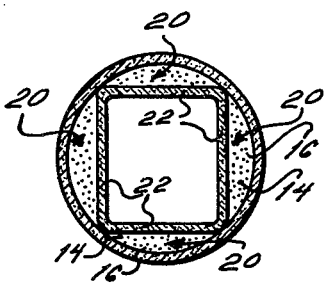
FIG. 4 is a cross-sectional view of still a further embodiment of the present invention.

In FIG. 4, there is shown a filament wound tube of rectangular cross-section which has a quadrilateral arrangement of discrete reinforcing regions 20 disposed on the four faces that are covered by a filament wound resin bonded fiberglass coating 22. The construction of reinforcing zones 20 with strengthening fibers 14 in an epoxy matrix 16 is the same as that described for FIGS. 1 through 3 and so need no further description herein.

In FIGS. 1 through 4 the discrete regions 12 and 20 were shown and described as running the length of tube or pole 10 and having the longitudinal axis of the reinforcing fibers substantially parallel to the generatrix of tube 10. Hence, the pre-stressing of strands or longitudinals 14 is accomplished by tautly winding them in a continuous coil-like array with portions thereof wound over and bearing against the ends of the pipe. After resin 16 sets, the ends are cut off and discarded with the pole body proper remaining in a stressed condition.

Other constructions utilizing the inventive concept are apparent.

Figure 6:
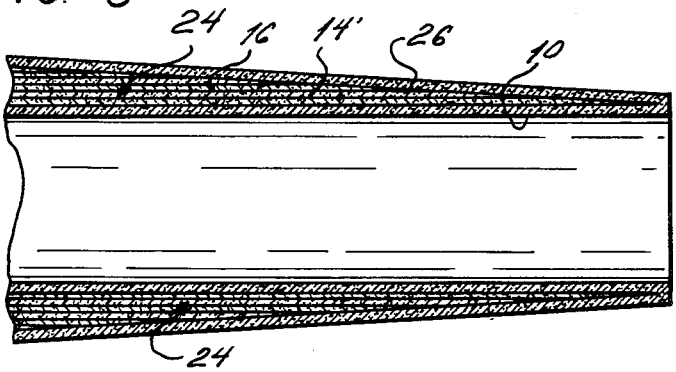
FIG. 6 is a section taken along line 6—6 in FIG. 5.
Figure 5:
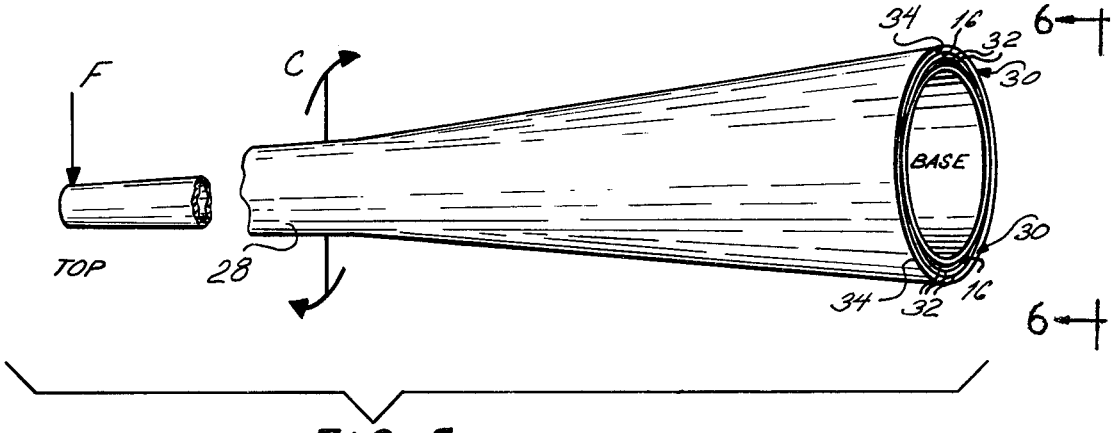
FIG. 5 is perspective representation in cross section of yet another embodiment of the present invention having a tapering cross section constructed of a stepwise array of longitudinal reinforcing fibers.

For example, in FIGS. 5 and 6 there is shown a modified form of the present invention wherein a maximum amount of reinforcement is at one end of the pole and a minimum amount of reinforcement at the other. Integrally formed with pole 10 are discrete regions 24, two of which are shown in a bilateral disposition for illustrative purposes only, that taper or flare outwardly at the base. Each region 24 is constructed of a longitudinal array of pre-tensioned strand packets 14' that vary stepwise in length. To lock the ends of those strand packets that extend only partway along the longitudinal length of pole 10, a circumferential helical or hooplike winding of fiberglass strands 26 is laid contiguous to each stepwise layer to fasten the same to the pipe. The tapering cross section of region 24 is shown coextensive or running substantially the length of pipe 10 and includes an outer jacket 28 wound integrally therewith. The length of each tapering section or region is readily changed so that in some applications, region 24 will be formed so as to be coextensive or cover only part of the longitudinal length of pipe 10.

Preferably, pipe or pole 10 will consist of wound fiberglass-epoxy or fiberglass-polyester. Strands 14 and 26 may consist of fiberglass strands, carbon filaments, metallic wire such as high tensile steel wire, nylon filaments, ray filaments and the like. Covering or jackets 16, 18 and 28 will preferably be comprised of filament wound, resin bonded fiberglass.

In FIG. 5 there is shown schematically typical forces F and C exerted on a utility pole by transmission lines carried by the pole.

Several suitable resins are currently available. For example, in the thermosetting resins, the epoxy resin is normally a conventional epoxy resin derived from epichlorohydrin and bis-phenol A, but may be of other epoxy resins. As a hardening agent use can be made of primary aliphatic polyamines, modified primary aliphatic polyamines, cyclic aliphatic amines, aromatic amines, tertiary amines, latent curing agents, polamides, and acid anhydrides. These components are commonly used in conventional ways to create epoxy resin systems. A polyester resin used in either of the thermosetting resin systems is normally derived from the reaction of discarboxylic acid with dihydric alcohol. To the polyester resin is added a hardening agent, which is normally a reactive monomer. Pigments may be incorporated into all resin systems to impart color to the interior and exterior layers of tube 10.

While only a few embodiments of the present invention have been shown and described, it will be apparent that many changes and modifications can be made hereto without departing from the spirit and scope hereof.

What is claimed is:

1. A structural element comprising a resin bonded filament wound pole, a discrete reinforcing region integral with said pole and perimetrically disposed and selectively placed thereon, said region being formed of a composite material including a plurality of pre-stressed longitudinally disposed fibers and a bonding agent embedding and structurally joining said fibers to said pole, said fibers being cast under stress in said bonding agent so that said pole is in stressed condition after the bonding agent is set, the bonding of said pre-stressed fibers to said pole by said bonding agent in said discrete reinforcing region serving to integrate said reinforcing region with said pole to increase the inertial moment thereof and provide increased resistance to tensile and compressive stresses, said fibers being bunched in separate packets and varying stepwise in longitudinal length along said pole to define a narrowing taper for said reinforcing region along said pole, the thickness of said region along said pole varying in relation to said taper.

2. The structural element of claim 1, said region including an outer covering of resin bonded wound filament rendered integral with said pole.

3. The structural element of claim 1, said region placed on the outside periphery of said pole.

4. The structural element of claim 1, said region disposed on the inside periphery of said pole.

5. The structural element of claim 2, including another one of said regions on said pole with both of same on the outer periphery thereof and placed opposed thereon.

6. The structural element of claim 2, including another one of said regions on said pole with both of same on the inside periphery thereof and placed in confronting relation thereon.

7. The structural element of claim 1, including a plurality of said regions, said regions on the pole and placed in quadrature thereabout.

8. The structural element of claim 7, said quadrilateral array of regions on the outer periphery of said pole and equally spaced thereabout.

9. The structural element of claim 7, said quadrilateral array of regions on the inside periphery of said pole and equally spaced thereabout, said regions including an outer covering of wound fiberglass rendered integral to said pole.

10. The structural element of claim 1, said region being coextensive with the length of said pole.

11. The structural element of claim 1, said region disposed part way along the longitudinal length of said pole.

12. The structural element of claim 1, said fibers being comprised of steel and said bonding agent being an epoxy resin.

13. The structural element of claim 1, wherein said pole has a constant cross-section over the length thereof, said longitudinally disposed fibers extending parallel to said pole along the length thereof in said packets to provide the taper for said reinforcing region.

14. The structural element of claim 13, wherein successive packets of fibers proceeding from the narrow end of the reinforcing region extend only part way along the length of said pole, said structural element comprising circumferential anchoring means for fastening to the pole the fibers of the packets extending only part way along the length of the pole.

15. The structural element of claim 14, wherein said circumferential anchoring means comprises fiberglass strands placed contiguous to each stepwise pocket.

* * * * *